United States Patent [19]

Fujikawa et al.

[11] Patent Number: 4,658,767

[45] Date of Patent: Apr. 21, 1987

[54] VERTICAL SHAFT V-TYPE ENGINE

[75] Inventors: Tetsuzo Fujikawa, Kobe; Makizo Hirata; Shinichi Tamba, both of Kakogawa, all of Japan

[73] Assignee: Kawasaki Jukogyo Kabushiki Kaisha, Kobe, Japan

[21] Appl. No.: 780,652

[22] Filed: Sep. 26, 1985

[30] Foreign Application Priority Data

Sep. 28, 1984 [JP] Japan ..... 59-205235

[51] Int. Cl.[4] ..... F01B 31/00

[52] U.S. Cl. ..... 123/52 MV; 123/195 HC; 123/196 W

[58] Field of Search ..... 123/52 MV, 55 VF, 559 R, 123/198 E, 195 C, 195 HC, 196 W

[56] References Cited

U.S. PATENT DOCUMENTS

| | | | |
|---|---|---|---|
| 2,309,227 | 1/1943 | Ware | 123/559 |
| 3,259,752 | 7/1966 | Honda | 123/41.62 |
| 4,156,409 | 5/1979 | Nakano | 123/195 C |
| 4,561,386 | 12/1985 | Tamba et al. | 123/195 C |
| 4,570,584 | 2/1986 | Uetsuji et al. | 123/195 HC |

*Primary Examiner*—Craig R. Feinberg

[57] ABSTRACT

A vertical shaft V-type engine having a vertical crankshaft and a pair of right and left hand cylinders arranged in V-shape, the engine comprising a carburetor arranged within a V-bank defined between both cylinders and an air cleaner arranged upwardly of the carburetor. The engine is also provided with an air fan and the air cleaner is arranged adjacent to a fan housing of the air fan.

2 Claims, 4 Drawing Figures

VERTICAL SHAFT V-TYPE ENGINE

BACKGROUND OF THE INVENTION

1. Field of the Invention

This invention relates to vertical shaft V-type engine having a vertical crankshaft and also a pair of right and left hand cylinders arranged in V-shape.

2. Description of the Prior Art

An engine as described above is used widely in power lawn mowers. In the past, a vertical-shaft single cylinder engine as described in U.S. Pat. No. 3,118,433 has been utilized as the engine for power lawn mowers, but in a single cylinder engine, a major drawback in use is the tendency to cause vibrations in operation of an engine having a relatively large engine output.

Also, in the V-type engine, since various engine auxiliary and accessory devices are arranged in positions limited by the engine, the engine is difficult to design so as to have a compact construction. Furthermore, the engine must have excellent stability by lowering its center of gravity.

SUMMARY OF THE INVENTION

It is one of the main objects of the invention to provide a vertical shaft V-type engine in which the engine itself is compact and maintenance of the engine auxiliary and accessory devices near the carburetor is easy.

It is another object of the invention to remarkably decrease intake sound noise.

In a construction according to the invention, this may be achieved by means of an arrangement of the carburetor within a V-bank defined between both cylinders and by arrangement of an air cleaner upwardly of said carburetor.

In another construction according to the invention, the air cleaner is arranged adjacent to a fan housing of a fan.

In a further construction according to the invention, a fresh air-intake port of the air cleaner opens into the fan housing.

Furthermore, the invention may be directed to an air cooled engine and also applicable to a liquid cooled engine.

According to the invention, it is possible to lower the position of the center of gravity of the engine, thereby the operation can be performed in a stable state for use in a power lawn mower, and further it is possible to lower the height of the cylinder head, so that a lubrication system of valve gear, which is provided on the cylinder can be substituted for cheap oil mist lubrication system.

These and other features and advantages of the present invention will be move fully understood and appreciated from the following description of specific embodiment taken together with the accompanying drawings.

BRIEF DESCRIPTION OF THE DRAWINGS

The invention will now be described in greater detail with reference to the drawings in which.

DESCRIPTION OF THE PREFERRED EMBODIMENTS

Figure 1:
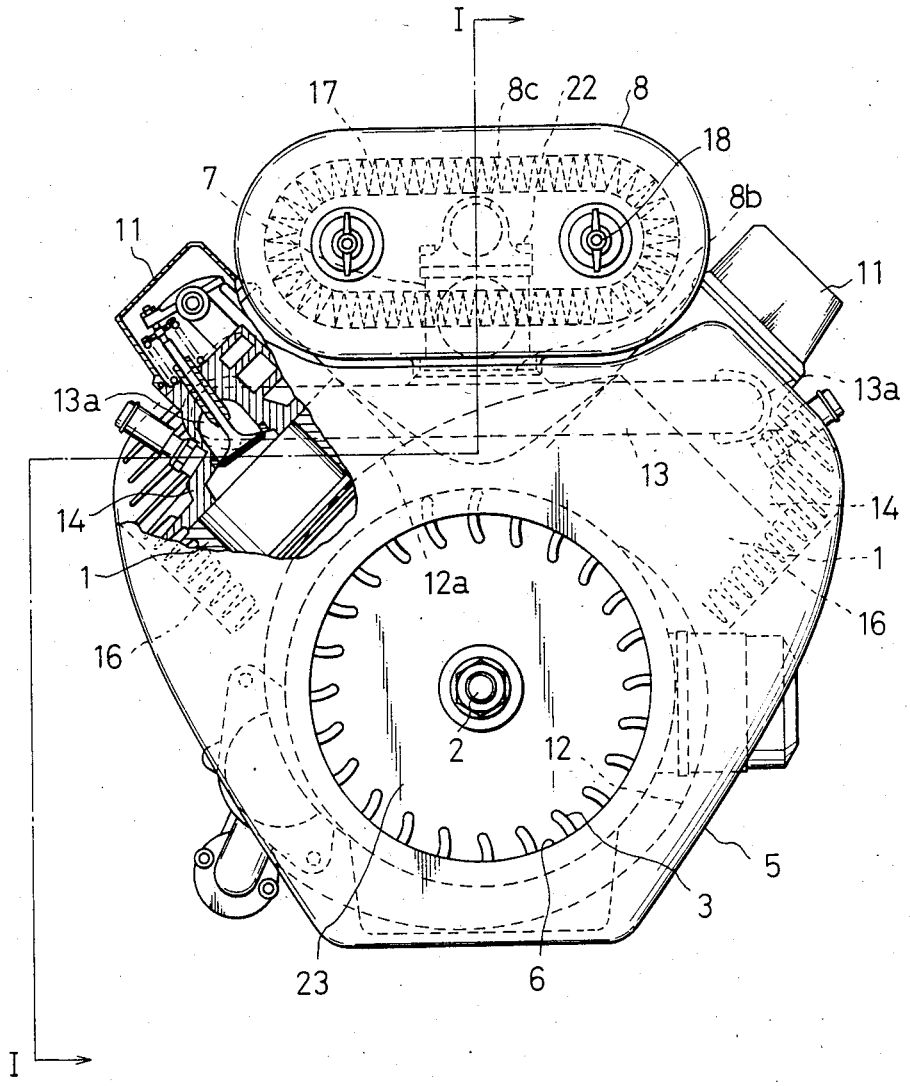
FIG. 1 is a top plan view of a basic example of an air cooled vertical V-type engine in accordance with the invention.

Referring now to the drawings in detail, there are shown the preferred embodiments of the invention of a vertical shaft V-type engine.

Figure 2:
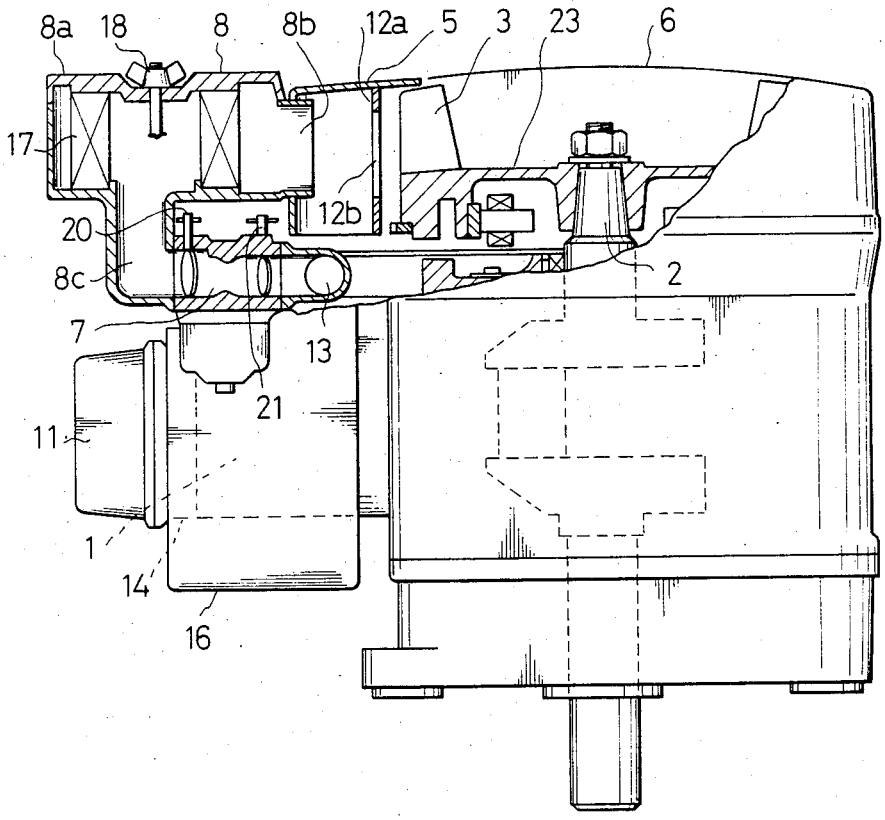
FIG. 2 is a partially sectional side view taken on lines I—I of FIG. 1.

Referring to FIGS. 1 and 2, a pair of right and left hand cylinders 1, 1 is arranged in V-shape such that the bottom portions of said cylinders are opposed to a vertical crankshaft 2. An upper end of the crankshaft 2 has a flywheel 23, and an air fan 3 is mounted on an upper face of the flywheel 23. A fan housing 5 is provided on the top side of both cylinders 1, 1 and said fan housing 5 is provided with a suction air opening 6 formed coaxially with the crankshaft 2.

A carburetor 7 is arranged within a V-bank defined between both cylinders 1, 1 and an upper portion of said carburetor 7 is provided with an air cleaner 8 such that the former surrounds the latter. The carburetor 7 is of the side draft type and is secured to an intake manifold 13 together with the air cleaner 8 by bolts 22 passing through the carburetor 7. The air cleaner 8 is of an elongated circular shape and its long side portion is closer to the fan housing 5. The air cleaner 8 is also arranged such that it is located between both rocker arm covers 11. The air cleaner 8 is arranged upwardly of the carburetor 7, thereby the carburetor 7 can be simply inspected from the front of the V-bank and maintenance of the carburetor is easy. Furthermore, the portion upwardly of the circumference of the carburetor 7 is covered with the air cleaner 8 and the fan housing 5, so that a deposition of dust on the carburetor 7 and around it can be prevented. That is, the air cleaner 8 serves as the dust cover, and as a result, the carburetor can be protected from dust.

The numerals 12 and **12*a* show a partition plate within the fan housing 5. The partition plate 12 directs a cooling air to the left hand cylinder 1, the partition plate 12*a* directs the cooling air to the right hand cylinder 1 and the opening 12*b* on the partition plate 12*a* directs the fresh air to the carburetor 7 through the air cleaner 8**.

The numeral 13 shows an intake manifold having a T-connection (i.e. center branch), this manifold 13 is connected with the carburetor 7, and both end outlets **13*a* of the manifold 13 are connected to an intake port of cylinder head 14. Said port is open on the upper end face of the cylinder head 14. The center branch portion of the intake manifold 13** is brought closer to the cross-over point of the V-bank.

As shown in the FIG. 2, each cylinder 1 is covered with a cooling air duct 16, which is arranged on both sides of each cylinder 1, an upper end portion of each duct 16 communicates with an inner portion of the fan housing 5, and a lower end exit portion of each duct 16 opens downwardly to the atmosphere.

The air cleaner 8 is provided with a cleaner element 17 in its interior and also secured to a cleaner cover **8*a* by a butterfly nut 18 or the like in its upper portion. A fresh air-intake port 8*b* of the air cleaner 8 projects within the fan housing 5 and opens into a side wall of the fan housing 5. A fresh air passage 8*c* of the air cleaner 8 extends downwardly to connect said passage with the carburetor 7. The numeral 20 shows a choke lever of the carburetor 7, and 21 shows a throttle lever thereof. The overhang of the air cleaner 8** beyond the engine can be reduced, while the whole engine construction is compact.

When operating the engine, air is firstly sucked in and pressed into the fan housing 5 from the suction air opening 6 by rotating the air fan 3. Part of the air is supplied to the air cleaner 8 from the fresh air port 8*b* through the opening 12*b* (FIG. 2) of the partition plate 12*a* and is further supplied to the carburetor 7 through the fresh air passage 8*c*. The air is mixed with fuel oil within the carburetor 7, whereafter the fuel-air mixture is supplied to the manifold 13, therein said fuel-air mixture is divided and supplied to each cylinder 1 through the suction passage of each cylinder head 14.

A residual part of the air in the fan housing 5 is also supplied to the cooling air duct 16 through the partition plates 12 and 12*a*, and discharged from a lower end of the duct 16 transversely across the cylinders 1, 1 and cylinder heads 14.

In the modified embodiment according to the invention, the air cleaner cover 8*a* may be formed integrally with the fan housing 5. Although the invention is described in the above embodiments with regard to an air cooled vertical shaft V-type engine, of course, the invention may be applied to a liquid cooled vertical shaft V-type engine.

Figure 3:
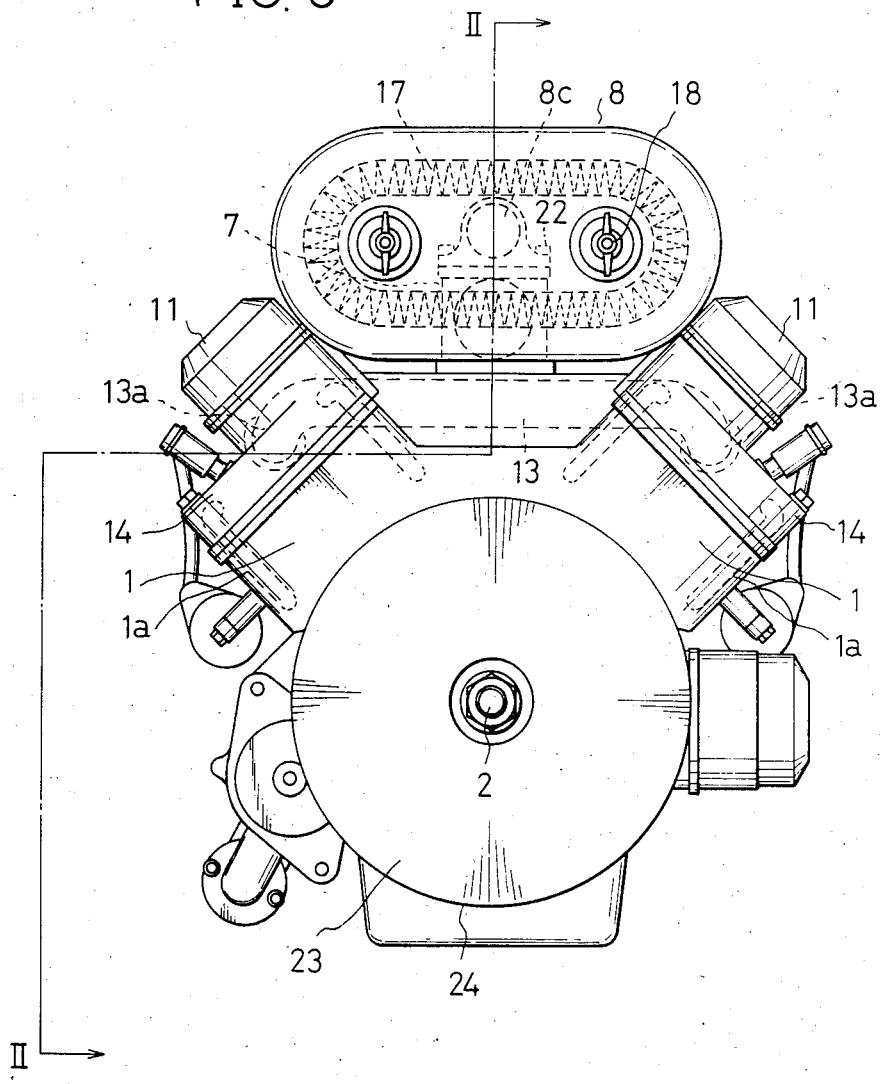
FIG. 3 is a top plan view of a liquid cooled vertical V-type engine.
Figure 4:
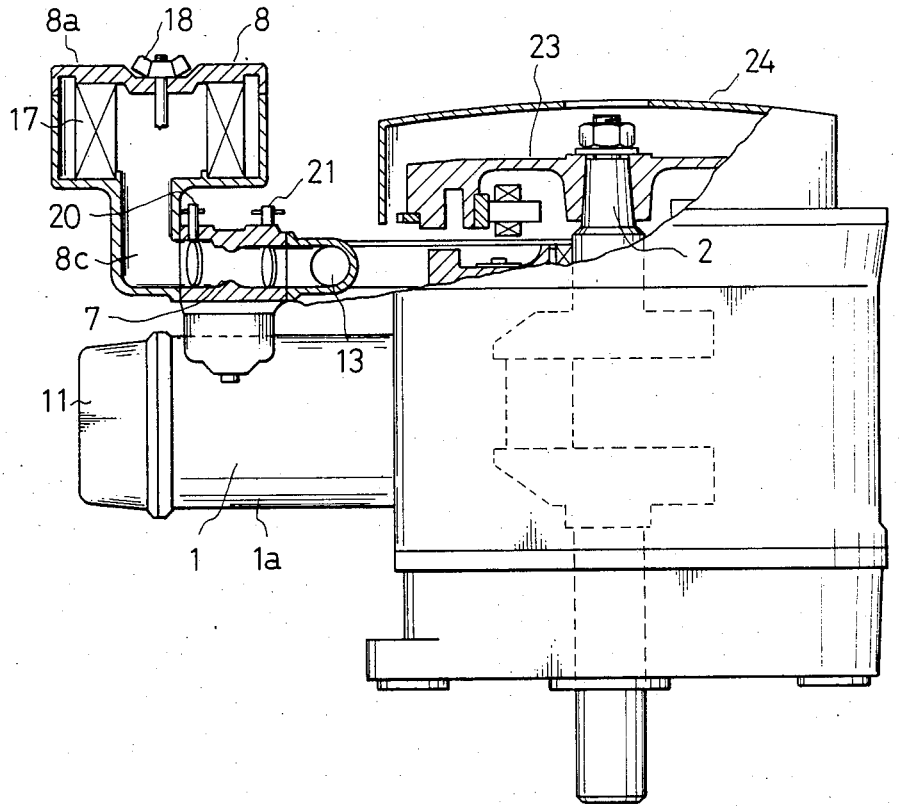
FIG. 4 is a partially sectional side view take on lines II—II of FIG. 3.

This will be evident from FIGS. 3 and 4 in which is shown the liquid cooled vertical V-type engine. Referring to FIGS. 3 and 4, the engine has the flywheel 23 at the upper end of the crankshaft 2. However, it is not necessary for such liquid cooled construction to provide the air fan, fan housing and air cooling system. The numeral 24 shows a cover for protecting the flywheel 23. The numeral 1*a*, shows two cylinder jackets, which are provided to each cylinder 1. Furthermore, the connection of the carburetor 7, air cleaner 8 and intake manifold 13 is the same as in the case of the air cooled construction as mentioned in the above.

While the invention has been described by reference to a particular embodiment chosen for purposes of illustration, it should be recognized that numerous changes could be made within the scope of the inventive concepts disclosed. Accordingly it is intended that the invention not be limited to the described embodiment but that it have the full scope permitted by the language of the following claims.

What is claimed is:

1. A vertical crankshaft V-type engine comprising: a vertical crankshaft having an upper end, a pair of cylinders arranged horizontally forming a V with respect to each other, and each having a cylinder head; a carburetor operatively connected to said cylinders and mounted in the V defined by said cylinders; an air cleaner operatively connected to said carburetor and mounted upwardly of said carburetor; a flywheel secured to the upper end of the crankshaft; an air fan mounted on top of said flywheel; a fan housing covering said cylinders and said air fan, and having a side wall along the crankshaft; and means for providing air from said fan to said air cleaner and to said cylinder heads for cooling the latter; said means including an air-intake port leading to said air cleaner and extending substantially normal from said side wall and also including an air duct mounted inside said side wall located substantially perpendicular to said port and connected to said air fan in communication therewith for conducting air to said cylinder heads.

2. A vertical crankshaft V-type engine as set forth in claim 1, wherein said air duct includes a partition plate mounted in said fan housing adjacent to said air cleaner for separating air flow from said air fan so that said cylinders are supplied with air separately, said partition plate having a passage for deflecting part of the air from said air fan to said air-intake port of said air cleaner.

* * * * *